US005969285A

United States Patent [19]

Krebs

[11] Patent Number: 5,969,285

[45] Date of Patent: Oct. 19, 1999

[54] DROP-IN BARREL FOR RECOIL OPERATED PISTOLS

[76] Inventor: Marc K. Krebs, 340 Waukegan Rd., Glenview, Ill. 60025

[21] Appl. No.: 09/075,041

[22] Filed: May 8, 1998

[51] Int. Cl.[6] ..... F41A 5/00; F41A 3/00; F41C 5/00; F41F 5/00

[52] U.S. Cl. ..... 89/163; 89/187.01; 89/171

[58] Field of Search ..... 89/163, 187.01, 89/189, 173.175, 168, 166

[56] References Cited

U.S. PATENT DOCUMENTS

| | | | |
|---|---|---|---|
| 808,003 | 5/1905 | Browning | 89/163 |
| 1,423,358 | 5/1922 | Penderson | 89/163 |
| 1,517,328 | 12/1924 | Weiss | 42/77 |
| 2,898,693 | 8/1959 | Ruger | 42/77 |
| 3,150,458 | 9/1964 | Browning | 42/75.02 |
| 3,280,495 | 10/1966 | Lewis | 42/59 |
| 3,564,967 | 2/1971 | Violette | 89/163 |
| 4,031,808 | 6/1977 | Raville | 89/163 |
| 4,178,833 | 12/1979 | Miller | 89/163 |
| 4,344,352 | 8/1982 | Yates et al. | 89/198 |
| 4,542,606 | 9/1985 | Hoenig | 42/75.02 |
| 4,580,484 | 4/1986 | Moore | 89/128 |
| 4,608,909 | 9/1986 | Peters | 89/196 |
| 4,615,132 | 10/1986 | Smith | 42/25 |
| 4,707,942 | 11/1987 | Peters | 42/77 |
| 4,729,186 | 3/1988 | Rieger | 42/75.04 |
| 5,654,519 | 8/1997 | Albrecht et al. | 89/163 |
| 5,678,343 | 10/1997 | Menges et al. | 42/75.02 |
| 5,706,599 | 1/1998 | Knight | 42/75.02 |

*Primary Examiner*—Michael J. Carone
*Assistant Examiner*—Jeffrey Howell
*Attorney, Agent, or Firm*—Leydig, Voit & Mayer, Ltd.

[57] ABSTRACT

A drop-in barrel is provided that utilizes an extended locking recess and a spring clip retained within the locking recess to reduce the engagement tolerance between the slide and barrel of a recoil pistol, thereby achieving the performance necessary for competitive shooting.

21 Claims, 6 Drawing Sheets

DROP-IN BARREL FOR RECOIL OPERATED PISTOLS

FIELD OF THE INVENTION

The present invention relates to recoil operated pistols and more particularly, to a drop-in barrel for such pistols.

BACKGROUND OF THE INVENTION

Recoil operated pistols include a slide which receives a barrel. The barrel has locking recesses comprising semicircular grooves which are formed around its circumference and engage locking lugs within the slide. Typically, recoil operated pistols utilize "drop-in" barrel assemblies, which, for any specific model of pistol, are of uniform (standard) size. The tolerances provided between a standard drop-in barrel and slide are sufficient for many shooting applications. However, for more precise gun performance, such as that required for competitive shooting, more precise (i.e., lower) tolerances between the slide and barrel are necessary. Consequently, guns used in competition most often utilize fitted barrels—i.e., barrels which are machined and stoned by a gunsmith to achieve the proper low-tolerance fit within the slide. Fitting a barrel to a slide in this manner is a time-consuming and, thus, costly procedure.

To date, the industry has failed to afford a reliable and economical means of reducing the tolerances between a slide and barrel of a recoil operated pistol. It would be desirable to have a barrel which may be easily adapted to reduce the tolerances between a slide and barrel so as to be suitable for competitive shooting.

OBJECTS OF THE INVENTION

Accordingly, a general object of the present invention is to provide a barrel which overcomes the deficiencies of the prior art.

A more specific object of the present invention is to provide a drop-in barrel for recoil operated pistols that may be used to achieve a low-tolerance fit between the barrel and slide.

Yet a further object of the present invention is to reduce the costs associated with providing a recoil operated pistol suitable for competitive shooting.

SUMMARY OF THE INVENTION

An inexpensive drop-in barrel assembly is provided that will achieve the tolerances demanded by competitive shooting. Specifically, at least one of the locking recesses provided on a standard drop-in barrel is further machined to provide it with an arcuate surface of greater length than a standard recess (i.e., a recess extending below the center of the barrel), in which a spring clip may be retained. Spring clips of varying thickness may be inserted within this lengthened locking recess to reduce the tolerance between the locking recesses of the barrel and the locking lugs of the slide when the respective components are engaged. Spring clips of different thicknesses will necessarily be required as the dimensions of the gun components vary. The required spring clip thickness for any given application may be achieved by using a single spring clip having the proper thickness or by stacking a number of spring clips. As a result, the present drop-in barrel and spring clips may be used to achieve the tolerances necessary for competitive shooting.

These and other objects, features, and advantages of the present invention will become more readily apparent upon reading the following detailed description of exemplified embodiments and upon reference to the accompanying drawings herein.

DESCRIPTION OF THE EMBODIMENTS

Figure 1:
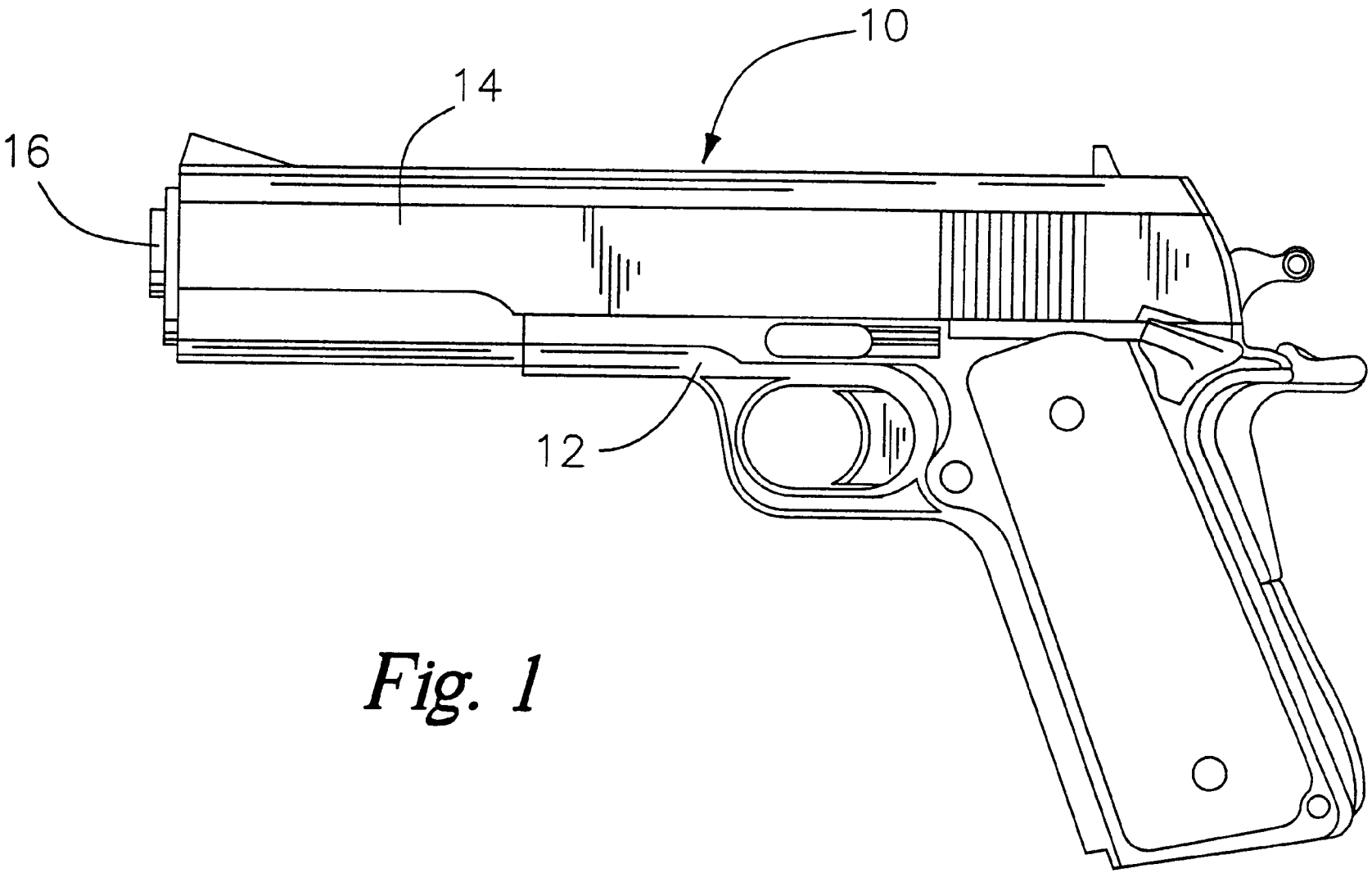
FIG. 1 is a side view of a recoil operated pistol.

The present invention provides a drop-in barrel that will achieve the tolerances demanded by competitive shooting and may be used with a variety of automatic recoil operated pistols. An illustrative example of such pistols is a Colt 1911, .45 caliber pistol as illustrated in FIG. 1. The pistol 10 comprises several primary components, including a receiver 12, a slide 14 and a barrel 16.

Figure 2:
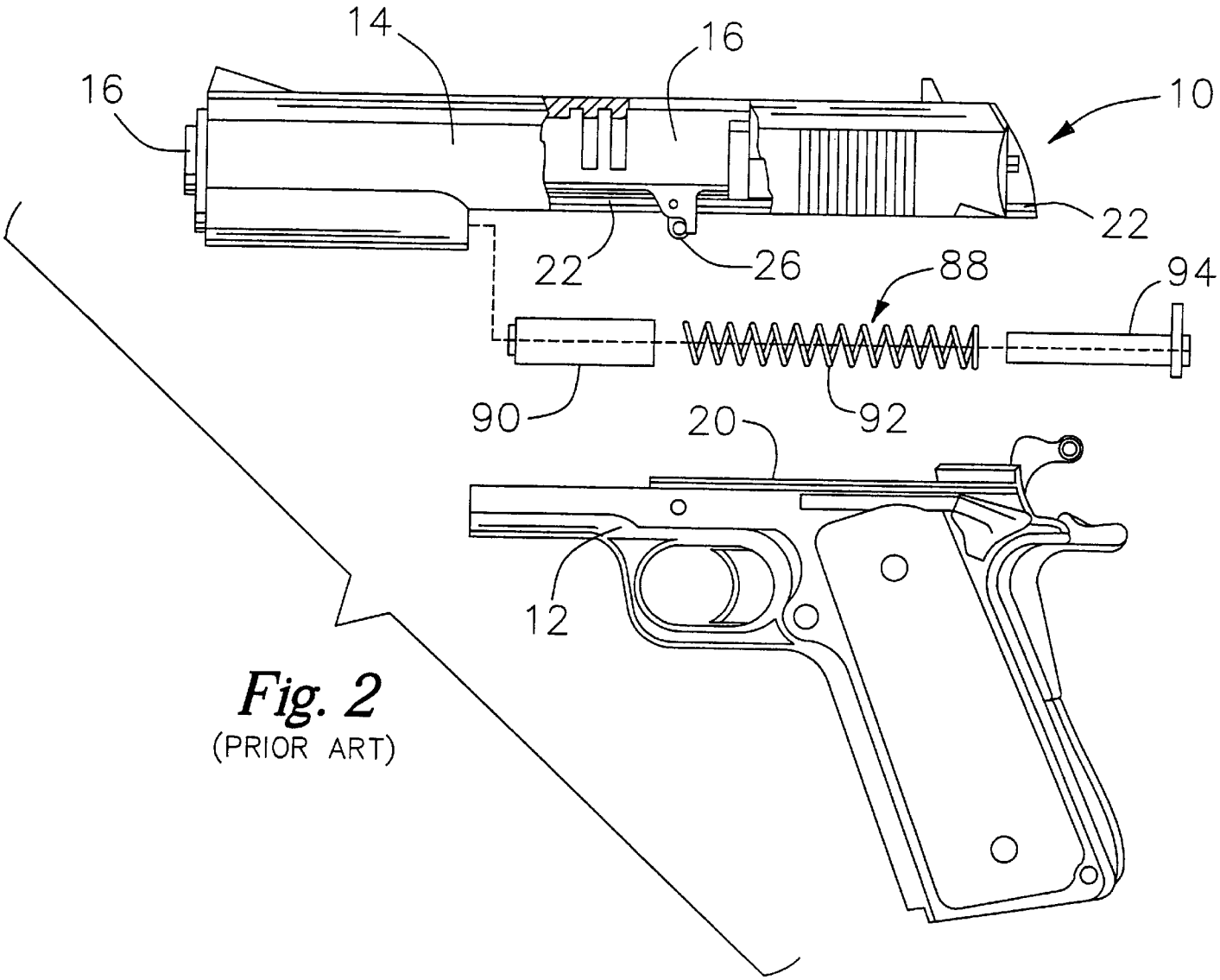
Fig. 2 (PRIOR ART)
FIG. 2 is a side view of the pistol of FIG. 1 illustrating the slide, the standard barrel and recoil assembly disassembled from the receiver and with a part of the slide being broken away to reveal the surface structure of the barrel.

As shown in FIG. 2, the slide 14 and barrel 16 of the pistol 10 form a longitudinal axis relative to the receiver 12. The slide 14 is coupled to the receiver 12 by a pair of longitudinally extending guide rails 20 on the receiver 12 and a matching pair of guide rails 22 on the slide 14. The barrel 16 is displaced within the slide 14 and is pivotally connected to the receiver 12 by a barrel link 26 and a pair of cylindrical pins.

Figure 3:
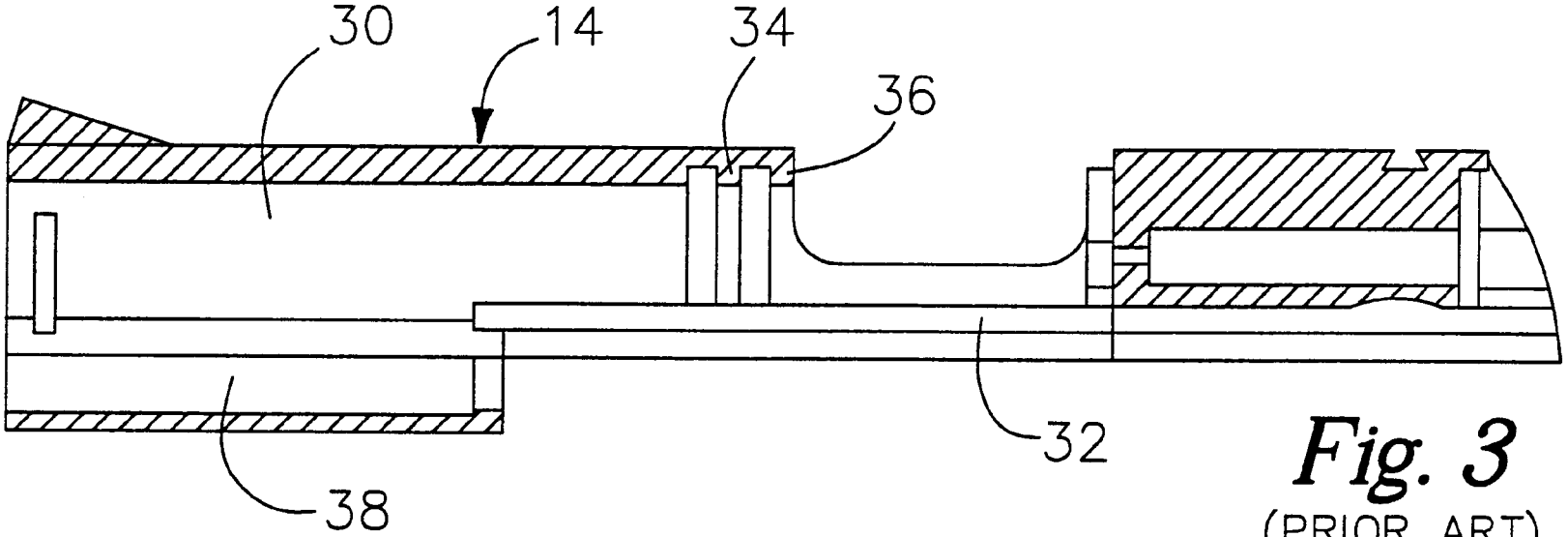
Fig. 3 (PRIOR ART)
FIG. 3 is a sectional view of the slide taken along its center line.

As illustrated in FIG. 3, the slide 14 provides a first locking lug 34 and a second locking lug 36 integrally disposed within and extending radially around the diameter of a generally U-shaped channel 30. The slide 14 also provides a bore 38 below the channel 30 for receiving a recoil assembly 88 (shown in FIG. 2). A barrel bushing 54 depicted in FIGS. 5 and 6 interlocks with the slide 14 thus retaining the recoil assembly 88 (comprising a plug 90, a spring 92 and a spring guide 94) within the bore 38 and maintaining proper vertical alignment between the slide 14 and the barrel 16. The spring 92 fits within the plug 90 and over the spring guide 94 and provides tension to bias the slide 14 to its engaged position with the barrel 16.

Figure 4:
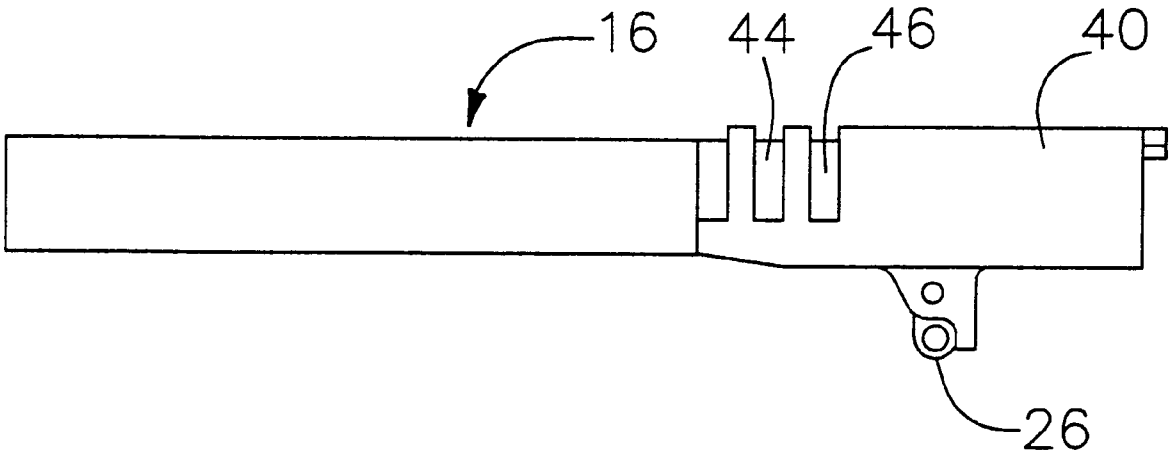
Fig. 4 (PRIOR ART)
FIG. 4 is a side view of the standard barrel.

The barrel 16, as most easily seen in FIG. 4, includes a base portion 40 having a first locking recess 44 and a second locking recess 46. The locking recesses 44, 46 comprise semicircular grooves formed partially around the circumference of the base 40 of the barrel 16, and engage the locking lugs 34, 36 within the slide 14. The semicircular design of the locking recesses 44, 46 is dictated by the fact that the slide channel 30 and the locking lugs 34, 36 disposed therein, are U-shaped, such that the locking lugs engage only the upper half of the base 40 of the barrel 16. The first locking recess 44 in the barrel 16 is adapted for receiving the first locking lug 34. Similarly, the second locking recess 46 is adapted for receiving the second locking lug 36.

Figure 5:
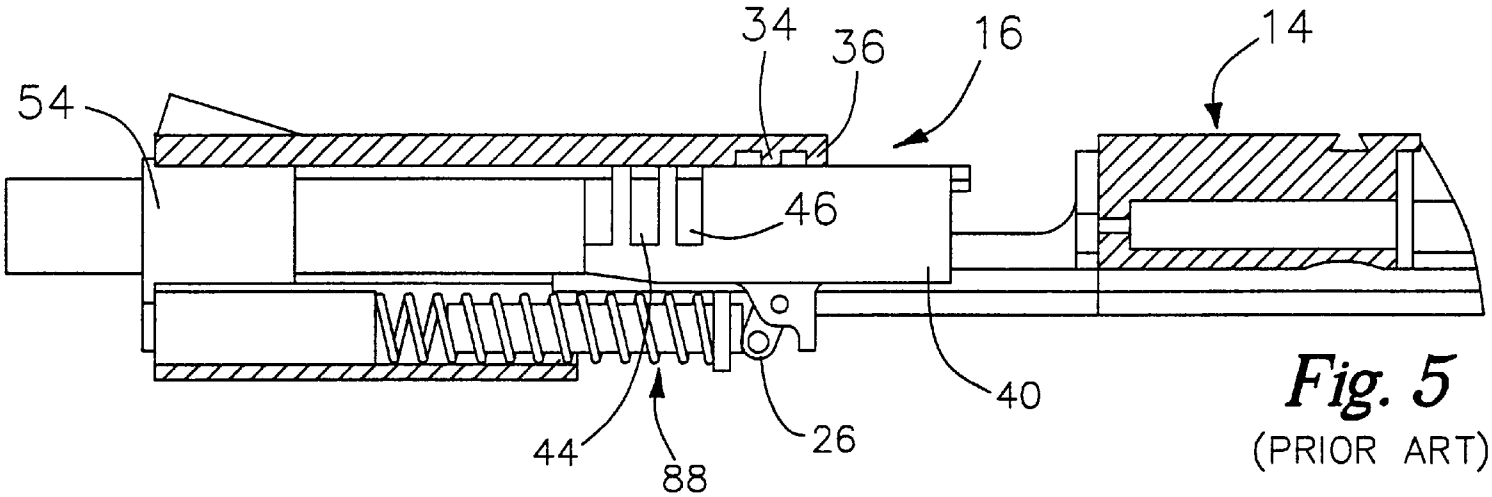
Fig. 5 (PRIOR ART)
FIG. 5 is an assembled view of the slide in FIG. 3, the standard barrel in FIG. 4 and illustrates their respective positions to one another while the slide and barrel are disengaged.
Figure 6:
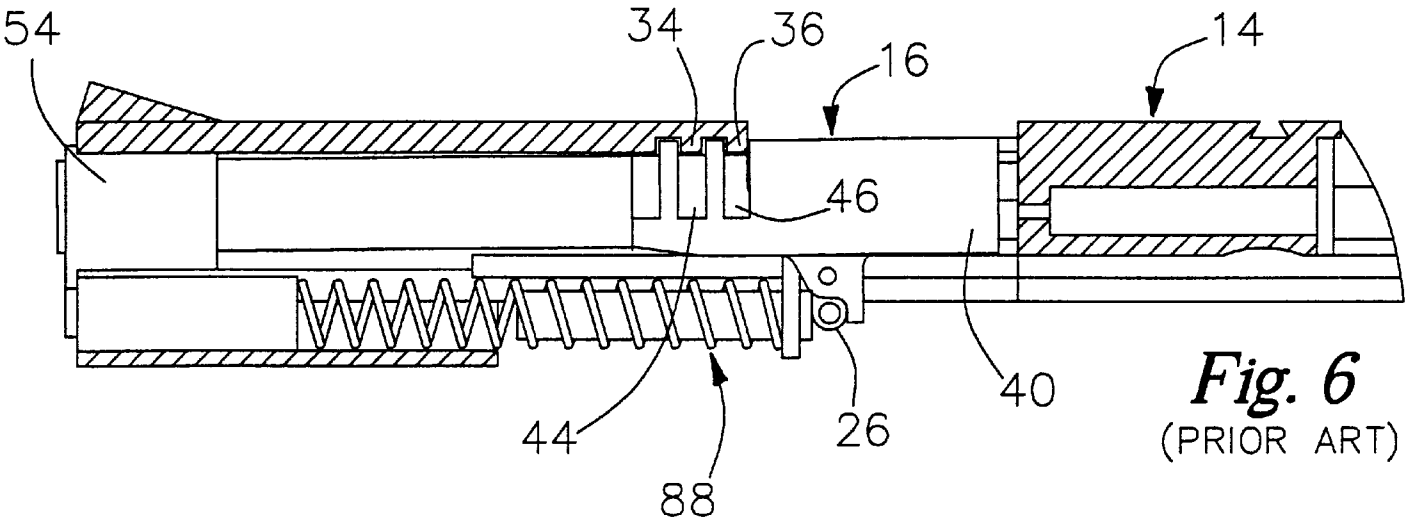
Fig. 6 (PRIOR ART)
FIG. 6 is an assembled view of the slide in FIG. 3, the standard barrel in FIG. 4 and illustrates their respective positions to one another while the slide and barrel are engaged.

FIGS. 5 and 6 illustrate the slide 14 in operation as it moves longitudinally along the guide rails 20, 22 relative to the receiver 12 and the barrel 16. The recoil assembly 88 is mounted between the receiver 12 and slide 14, and acts against the rearward longitudinal movement of the slide 14 by normally biasing the slide 14 to its forward-most position relative to the receiver 12 and barrel 16. Following firing of the pistol and recoil of the slide 14 relative to the barrel 16, the bias provided by the recoil assembly 88 causes the slide 14 to move forward relative to the receiver 12 and the barrel 16 until the end of barrel base 40 abuts the slide (thus preventing further longitudinal movement of the slide 14 relative to the barrel 16). The recoil assembly 88 continues to exert force against the slide 14, however, ultimately causing the barrel link 26 to pivot. This pivoting of the barrel link 26 causes a camming action and, in turn, vertical movement of the base 40 of the barrel 16 relative to the slide 14, while the barrel bushing 54 maintains the front end of the barrel 16 in a fixed vertical position. As the base 40 of the barrel 16 moves vertically within the slide 14, the locking lugs 34, 36 of the slide 14 engage the respective locking recesses 44, 46 of the barrel 16 (FIG. 6). This engagement of the locking lugs 34, 36 with the locking recesses 44, 46 prevents longitudinal movement of the barrel 16 relative to the slide 14. When the barrel 16 and slide 14 are in this "engaged" position, the pistol is considered to be in "battery," or the firing position. Upon firing the pistol, the force of the round being propelled from the barrel 16 drives the engaged slide 14 and barrel 16 rearwardly. The rearward momentum of the slide 14 forces the barrel 16 out of engagement with the slide 14 via the link 26. The slide 14 continues its rearward travel until ultimately the force provided by the recoil assembly 88 brings the slide 14 back into battery, such that another round may be fired.

Typically, recoil operated pistols utilize "drop-in" barrels, which for any specific model of pistol, are of uniform (i.e., standard) size. The tolerances provided between the locking lugs 34, 36 of a slide 14 and the locking recesses 44, 46 of a standard drop-in barrel 16 (the distance of relative movement between the locking lugs 34, 36 and the inner surfaces of the corresponding locking recesses 44, 46 to achieve an "engaged" position) are sufficient for many applications. As the tolerances between the locking lugs 34, 36 and locking recesses 44, 46 decrease, the accuracy of gun performance increases since the barrel becomes more secure (i.e., has less ability to move laterally and vertically) within the slide during firing. For precise gun performance, such as that required for competitive shooting, lower tolerances between the locking recess and locking lugs are critical. Consequently, guns used in competition often utilize fitted barrels.

Figure 7:
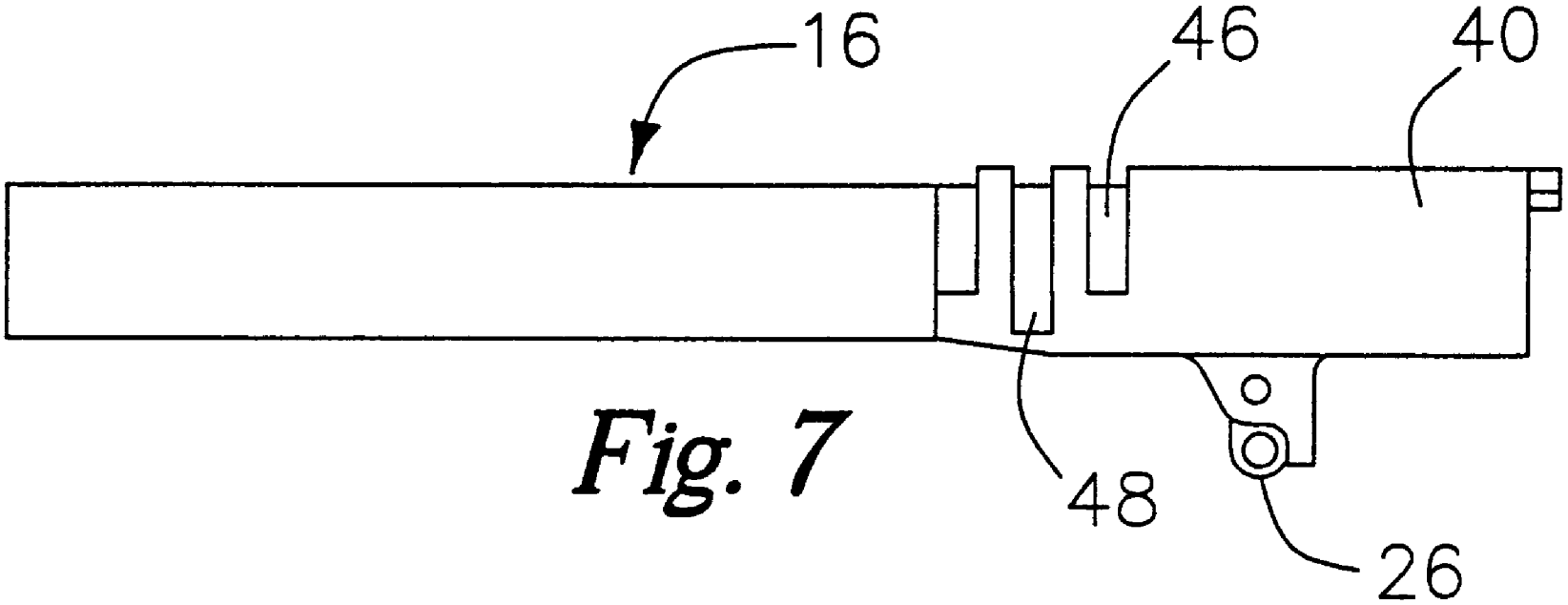
FIG. 7 is a side view of the barrel having an extended recess.
Figure 9:
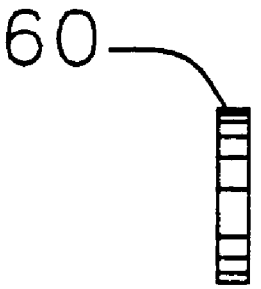
FIG. 9 is a side view of the spring clip in FIG. 8.
Figure 8:
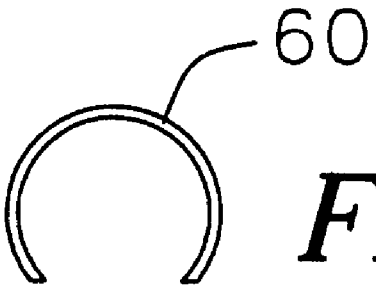
FIG. 8 is a front view of the spring clip.

The present invention provides means for adapting a drop-in barrel to achieve the low tolerances demanded by competitive shooting, thus eliminating the need for an expensive fitted barrel. As shown in FIG. 7, the first locking recess 44 of a drop-in barrel 16 is further machined to provide an extended recess 48 with an arcuate surface of greater length than a standard recess (i.e., a recess extending below the center of the barrel). A bushing in the form of a spring clip 60 (FIGS. 8 and 9) may be retained within the extended recess 48 and has the effect of reducing the "engaged" tolerance between the first locking lug 34 and the recess 48, which ultimately increases gun performance. Specifically, the spring clip 60 reduces lateral and vertical space between the first locking lug 34 and the recess 48 while they are engaged. The reduced space between the two components ensures the proper lateral position of the barrel 16 within the slide 14 and maintains the barrel 16 in secure vertical alignment relative to the slide 14.

It will be appreciated that the extended recess 48 may be formed in a standard factory barrel by subsequent machining techniques that are well known in the art, or the extended recess 48 may be formed during the manufacture of a barrel by traditional methods. It will also be appreciated that an extended recess may be formed as the first locking recess, as the second locking recess or as both the first and second locking recesses.

It has been found that spring clips 60 are particularly well suited for insertion into the extended recess 48 since they may be flexibly (and removably) attached within the recess. It will be appreciated, however, that other types of bushings may be used. Also, means of retaining a clip 60 (or other suitable bushing) within the extended recess 48 other than simply via spring action may be employed. Illustrative examples of such retaining means include, but are not limited to, adhesives or welding/soldering techniques. It has been found that 301 stainless steel (42 RC minimum) is a particularly desirable material for manufacture of the spring clip 60 because of its resiliency and heat resistance, although it will be appreciated in the art that many other materials may be suitably used. Spring clips 60 of various thicknesses (ranging between 0.015 inches through 0.020 inches) have been found to adequately reduce the tolerances for most applications, including competitive shooting. It will also be appreciated that spring clips 60 may be added to extended recesses 48 at the first locking recess position, the second locking recess position, or both the first and second locking recess positions, as desired.

Figure 10:
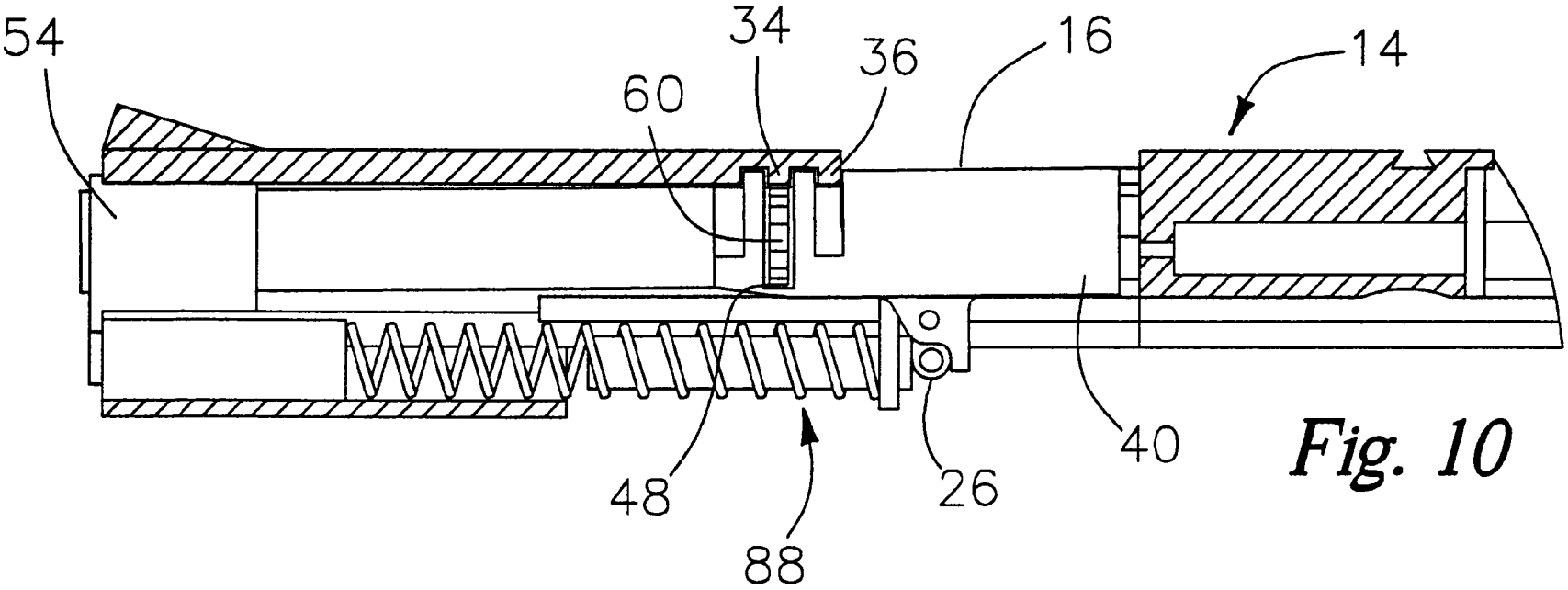
FIG. 10 is an assembled view of the slide in FIG. 3, the barrel in FIG. 7, and the spring clip in FIG. 9 and illustrates their respective positions to one another while the slide and barrel are engaged.

In accordance with an embodiment of the present invention, spring clips 60 of various thicknesses may be inserted within one or more extended recesses 48 to reduce the tolerances between the locking lugs 36 of the slide 14 and the locking recesses of the barrel 16 when the respective components are engaged as shown in FIG. 10. Each gun will potentially require spring clips 60 of different thicknesses since the dimensions of gun components vary. The required spring clip thickness for any given application may be achieved by using a single spring clip having the desired thickness or by stacking two or more spring clips to cumulatively achieve the desired spring clip thickness. As a result, a standard drop-in barrel 16 may be easily, inexpensively and adjustably modified by forming one or more extended recesses and inserting one or more spring clips to achieve the lower tolerances necessary for competitive shooting.

From the foregoing it will be understood that modifications and variations may be effectuated to the disclosed structures—particularly in light of the foregoing teachings—without departing from the scope or spirit of the present invention. As such, no limitation with respect to the specific embodiments described and illustrated herein is intended or should be inferred. Indeed, the following claims are intended to cover all modifications and variations that fall within the scope and spirit of the present invention.

I claim:

1. A recoil operated pistol assembly comprising:

a slide having a channel and at least one locking lug disposed within said channel;

a drop-in barrel dimensioned to fit within said channel of said slide and having at least one locking recess which is provided on an outer surface of said barrel and is disposed for engaging said locking lug; and at least one bushing, said bushing fitting within said locking recess and effectively reducing engagement tolerance between said locking lug and said locking recess.

2. The invention as in claim 1, wherein said bushing is an arcuate spring clip flexibly attached within said locking recess.

3. The invention as in claim 2, wherein said clip is made of stainless steel.

4. The invention as in claim 1, wherein said bushing is attached within said locking recess by adhesives.

5. The invention as in claim 1, wherein said bushing is attached within said locking recess by soldering techniques.

6. The invention as in claim 1, wherein said bushing is attached within said locking recess by welding techniques.

7. The invention as in claim 1, wherein said locking recess in said drop-in barrel receives a plurality of said bushings, said bushings being stacked on top of one another.

8. A drop-in barrel adapted for use with a recoil operated pistol having a slide with a channel and at least one locking lug disposed within said channel, said barrel comprising:

a base portion having at least one locking recess provided on its outer surface and disposed for engaging said locking lug; and at least one bushing dimensioned for mounting in said locking recess and for effectively reducing engagement tolerance between said locking lug and said locking recess.

9. The invention as in claim 8, wherein said bushing is an arcuate sping clip flexibly attached within said locking recess.

10. The invention as in claim 9, wherein said clip is made of stainless steel.

11. The invention as in claim 8, wherein said bushing is attached within said locking recess by adhesives.

12. The invention as in claim 8, wherein said bushing is attached within said locking recess by soldering techniques.

13. The invention as in claim 8, wherein said bushing is attached within said locking recess by welding techniques.

14. The invention as in claim 8, wherein said locking recess in said drop-in barrel receives a plurality of said bushings, said bushings being stacked on top of one another.

15. A method of reducing the engagement tolerance between a slide and a barrel of a recoil operated pistol, said method comprising the steps of:

providing a slide having a channel and at least one locking lug disposed within said channel;

providing a drop-in barrel which is dimensioned to fit within said channel of said slide and which has at least one locking recess provided on its outer surface and disposed for engaging said locking lug; and providing at least one bushing within said locking recess and thereby effectively reducing engagement tolerance between said locking lug and said locking recess.

16. The method as in claim 15, wherein said bushing is an arcuate spring clip flexibly attached within said locking recess.

17. The method as in claim 16, wherein said clip is made of stainless steel.

18. The method as in claim 15, further comprising the step of attaching said bushing within said locking recess by adhesives.

19. The method as in claim 15, further comprising the step of attaching said bushing within said locking recess by soldering techniques.

20. The method as in claim 15, further comprising the step of attaching said bushing within said locking recess by welding techniques.

21. The method as in claim 15, further comprising the step of stacking a plurality of said bushings on top of one another within said locking recess.

* * * * *